US005163892A

United States Patent [19]

Morris

[11] Patent Number: 5,163,892

[45] Date of Patent: Nov. 17, 1992

[54] FORMING MACHINE

[75] Inventor: John W. Morris, Walmley, England

[73] Assignee: Aston Packaging Limited, Birmingham, England

[21] Appl. No.: 732,831

[22] Filed: Jul. 19, 1991

[30] Foreign Application Priority Data

Jul. 21, 1990 [GB] United Kingdom ..... 9016072

[51] Int. Cl.[5] ..... B31D 5/04

[52] U.S. Cl. ..... 493/395; 493/405; 493/407; 493/464; 493/968

[58] Field of Search ..... 493/174, 185, 254, 395, 493/405, 407, 464, 480, 968

[56] References Cited

U.S. PATENT DOCUMENTS 3,655,500 4/1972 Johnson ..... 493/464

3,843,113 10/1974 Schaffar .

5,041,008 8/1991 Harvey ..... 493/405

FOREIGN PATENT DOCUMENTS 137926 7/1950 Australia ..... 493/395

101117 6/1961 Norway ..... 493/464

*Primary Examiner*—Bruce M. Kisliuk

*Assistant Examiner*—Jack Lavinder

*Attorney, Agent, or Firm*—Oblon, Spivak, McClelland, Maier & Neustadt

[57] ABSTRACT

Forming machine comprising a first and second pairs of former and jaw arrangements, each of the former and jaw arrangements being relatively movable from an open to a closed condition (and from the closed to the open condition), but only after corresponding movement of the other former and jaw arrangement.

9 Claims, 3 Drawing Sheets

FORMING MACHINE

This invention relates to a forming machine and in particular to a forming machine for converting a length of rolled corrugated paper into a similar length of shaped corrugated paper, particularly of angled corrugated paper but alternatively of other known shapes such as channels and flats.

BACKGROUND OF THE INVENTION

Shaped corrugated paper is used in packaging to protect the exposed outer surfaces of articles, and is valued for its exceptional cushioning against repeated impacts. Lengths of angled corrugated paper i.e. of "L" cross-section, are typically used for protecting the sides and more particularly the side corners of rectangular metal products, both in the warehouse and during transit. Angled corrugated paper is usually formed from single faced corrugated paper, so that the corrugated paper can bend along the lines of the corrugations.

Product packaging materials have a relatively short life. Suitably therefore they should be readily disposable after use, preferably in an environmentally-friendly manner, and furthermore desirably they should be made from renewable materials to limit the consumption of natural resources; corrugated paper is wood-based, desirably being made from recovered or waste paper, and so meets these requirements. Users however also demand of a product packaging material that it is consistent in shape and quality, for repeatable performance both when in use and during fitting, and that it does not add significantly to the cost of the packaged product. These additional requirements have, we believe, been one factor in constraining the wider use of angled corrugated paper against the competition from other packaging materials, typically oil-based packaging materials such as polystyrene.

SUMMARY OF THE INVENTION

Thus we now propose a forming machine for converting rolls of corrugated paper into corner lengths which permits greater consistency in the formed corner lengths but without a reduction in operator output. In particular we propose a double-headed forming machine constructed and arranged so that one length of angled corrugated paper can be formed, whilst another is being unloaded and a fresh length of rolled corrugated paper inserted ready for forming; thus a particular roll of corrugated paper can dwell in the machine for double the normal forming period of a standard single-headed machine, without however a loss of machine output.

Thus according to one feature of the invention we provide a forming machine for converting a length of rolled corrugated paper into a length of shaped corrugated paper wherein a first former and a corresponding first jaw assembly are relatively movable between an open condition and a closed condition, and which includes a second former and a corresponding second jaw arrangement also relatively movable between an open condition and a closed condition, but subsequent to the relative movement of the first former and jaw arrangement.

DETAILED DESCRIPTION OF THE INVENTION

The invention will be further described by way of example with reference to the accompanying schematic drawings in which:-

The machine includes an upper former 1*a* arranged to cooperate with an upper set of jaws 2*a*, and a lower former 1*b* arranged to cooperate with a lower set of jaws 2*b*.

Each former 1*a*, 1*b* has side faces 3 subtending an included angle of 90 degrees at leading edge 4.

Figure 1:
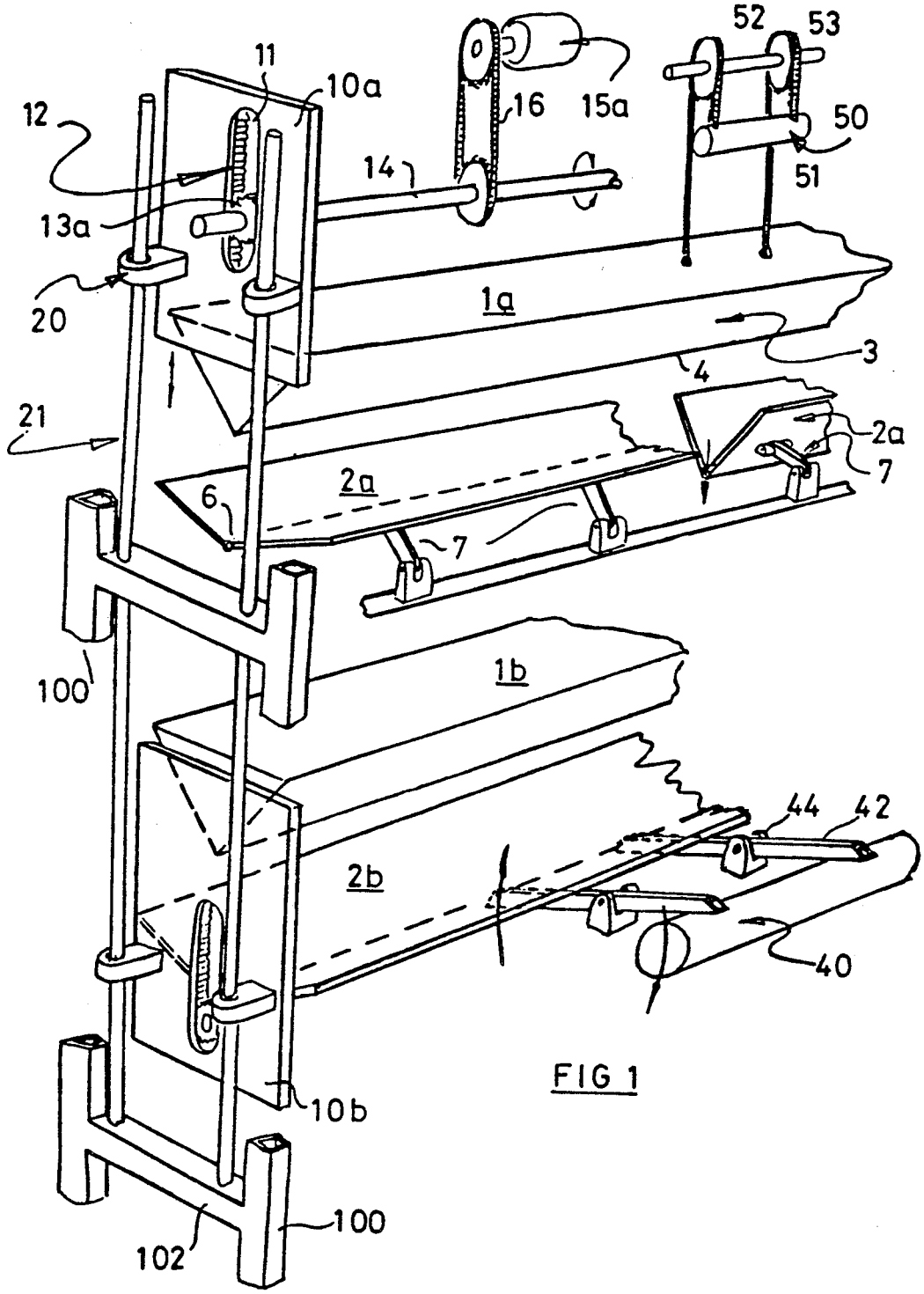
FIG. 1 is a perspective view of part of a forming machine according to the invention, with the upper jaws shown in the respective open and closed conditions.

In FIG. 1, upper jaws 2*a* are shown to the left in the open condition, and to the right in the nearly-closed condition; although a machine could be made with such separated jaws operating out of sequence, normally the upper jaws will all be open, concurrent with the lower jaws being closed, and vice versa.

Figure 2:
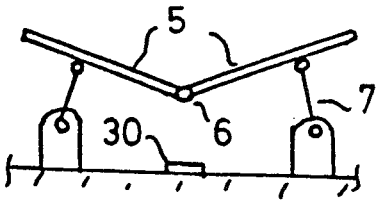
FIG. 2 is an end view of the pivoted jaws of the machine of FIG. 1 in the open or rest condition.
Figure 3:
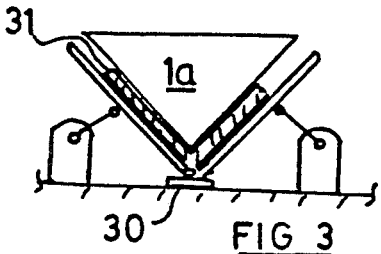
FIG. 3 is an end view of the pivoted jaws of the machine of FIG. 1 in the closed condition, and forming corrugated paper to an angled length.

As best seen in FIG. 2, jaws 2*a*, 2*b* each comprise two plates 5 connected together at pivot 6, and mounted on respective pivoted links 7, the plates in their rest or open condition as shown forming an angle of about 150 degrees to receive and retain a length of rolled corrugated paper 8 (FIG. 4) formed from a unitary length of single faced corrugated paper, having adhesive painted along the tips of the corrugations.

The upper former 1*a* is fixed to end plates 10*a* (only one of which is shown) each having an elongated recess 11 carrying a rack 12. Drivingly engageable with the rack 12 is a pinion 13*a* mounted on a pinion shaft 14 and rotated by electric motor 15*a* by way of an intermediate chain transmission 16. In an alternative arrangement, a different transmission can be used e.g. a belt drive, or the motor can be directly connected to the pinion.

Each end plate 10*a* has a pair of apertured bosses 20 slidable on respective fixed guide posts 21; apertured bosses 20 form linear bearing guides and in conjunction with the rack and pinion drive and close-tolerance guide posts 21 ensure an accurate and repeatable former movement, which is also relatively quiet, maintenance free and energy efficient.

Figure 4:
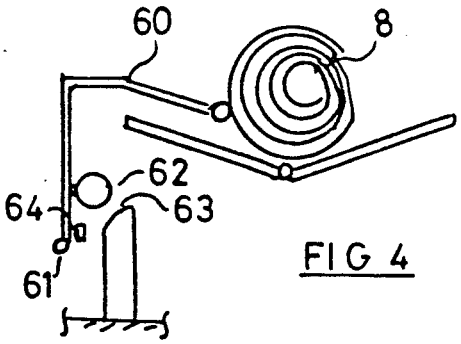
FIG. 4 is an end view of the pivoted jaws of the machine of FIG. 1 in the open condition, with a fresh roll of paper held offset from the centre line of the pivoted jaws.

In operation, former 1*a* is driven downwardly, in this embodiment by anti-clockwise rotation of the motor output shaft, from the position shown in FIG. 1 until its leading edge 4 engages a length of rolled corrugated paper (such as roll 8 of FIG. 4) resting in the obtuse angle. Further downward movement of former 1*a* will first slightly compress the roll 8 until gap stop 90 (FIGS. 6/7), in this embodiment at each end of a former 1*a*, 1*b*, engages plates 5; continued downward movement of the former 1, and thus of gap stops 90 is accompanied by pivoting of plates 5 until they are arrested by stop 30 (FIGS. 2/3). In this embodiment stop 30 is set so that the closure angle of the jaws is 90 degrees, but in an alternative embodiment it can be 85 degrees. In this arrested condition, the former 1*a* and plates 5 will deform the roll into a length of corrugated paper which conforms to the gap therebetween, in this embodiment a length of angled corrugated paper 8 (FIG. 4). Whilst the length of rolled corrugated paper is held between the former and the jaws, the adhesive between the corrugated layers is being cold-worked, whereby to retain the corrugated paper in its newly-deformed condition.

Whilst upper former 1*a* is being driven downwardly, lower former 1*b* is in its spaced position (FIG. 2), with a substantial gap between it and the jaws 2*b*. This permits a formed length of angled corrugated paper to be removed from jaws 2*b*, and a fresh length of rolled corrugated paper to be placed on the jaws 2*b* ready to be worked, concurrent with continued squeezing of a roll 8 between the upper former 1*a* and jaws 2*a*.

It will be understood therefore that closure movement of the upper former and jaws occurs subsequent to corresponding closure movement of the lower former and jaws. Whilst these respective movements are out of phase, we prefer that they do not overlap.

A "magic eye" or photoelectric sensor can scan the gap between the respective former and jaws to prevent continued downward movement of a former if the beam is interrupted, as by inadvertent operator intrusion into the gap during closure movement. A further "magic eye" can scan the space between jaws 2*a* and former 1*b*, again for operator protection. Whilst a fourth "magic eye" could be used above former 1*a*, this gap is more readily protected by a mechanical guard of sheet steel or equivalent. Alternative sensors can be fitted, as appropriate and as understood by those in the operator protective art.

Figure 9:
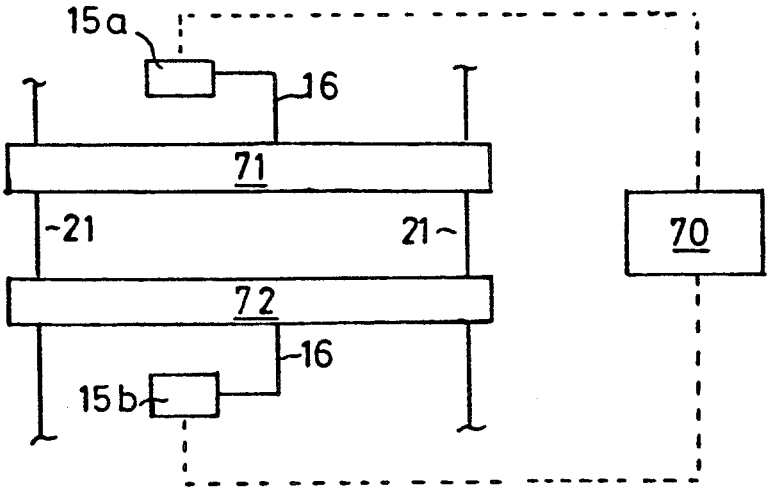
FIG. 9 is a schematic view of the machine and of its control.
Figure 6:
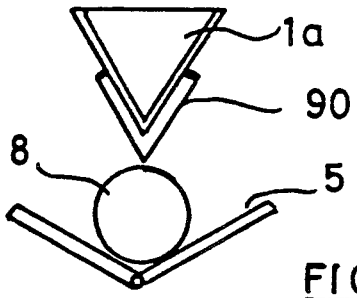
FIG. 6 is a partial end view of a former and gap stop.
Figure 7:
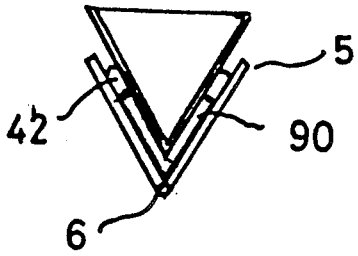
FIG. 7 is a view corresponding to that of FIG. 6, but with the former in the closed position.

In this embodiment the jaws 2*b* are returned to their open condition whilst the lower former 1*b* is being raised by reverse rotation of its motor 15*b* (FIG. 6). The jaws 2*b* are caused to follow the upward movement of lower former 1*b* by counterbalance 40 carried by arms 42 mounted on pivots 44 and engaging the underside of the jaws; in an alternative embodiment other means can be used, for instance a chain drive from the motor. It will be understood that jaws 2*a* are also engaged by a similar counterweight (not shown). It will also be understood that the lower former 1*b* is welded to end plates 10*b* which can be driven upwardly and downwardly by a motor 15*b* (FIG. 9) by means of pinion 13*b*.

The stress on each motor 15*a*, 15*b* during lifting of the respective former is reduced by the provision of weights 50 secured to each former 1*a*, 1*b*, by means of chains 51 passing over pulleys 52, pulley spindle 53 being rotatably mounted on the machine.

Figure 5:
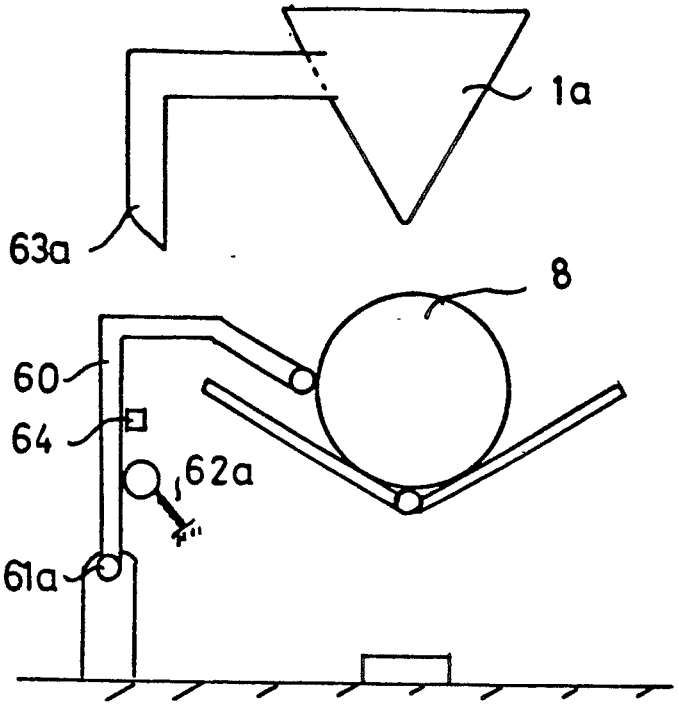
FIG. 5 is an end view of an alternative embodiment to that of FIG. 4.

To form lengths of angled corrugated paper with unequal legs, a spacer bar 60 can hold the roll 8 offset by the required amount until the roll 8 is pinched and thus located by the leading edge 4 of the former. Preferably with continued downward movement of the former, the spacer bar will be swung out of abutment with the roll 8. As indicated schematically in the embodiment of FIG. 4 the spacer bar is pivotally mounted on the former at 61, and has a follower 62 which will engage a cam 63 fixed to the machine frame; the spacer bar is weighted to swing back into position, preferably against an adjustable stop 64, when the former is returned to the start position of FIG. 1. In the preferred embodiment of FIG. 5, the spacer bar is pivotally mounted on the machine frame at 61*a*, and the cam 63*a* is mounted on the former, with the spacer bar biassed by spring 62*a* towards stop 64 i.e. clockwise as viewed in FIG. 5.

The motors 15*a*, 15*b* are energised in timed sequence and rotational direction by control panel 70, and in this embodiment are closed to order by the operator. One former/jaws sub-assembly 71 is in the open condition, with its former lifted, for unloading and loading a formed angle and a new roll respectively, whilst the other former/jaws sub-assembly 72 is in the closed condition, with the jaws closed at the 90 degree forming angle, with its associated former lowered to sandwich the corrugated paper to the predetermined compression in the shaped gap between the former and jaws. The time between the loading and subsequent unloading of a workpiece is sufficient for proper cold working of the adhesive to ensure that the length of angled corrugated paper remains dimensionally stable after removal from the machine, and during subsequent processing e.g. handling and sawing.

Figure 8:
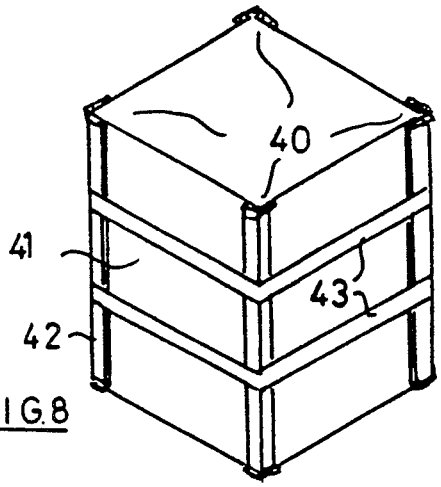
FIG. 8 is a perspective view of a "boiler pack" having the four side edges of the boiler protected by lengths of angled corrugated paper.

One suitable application of angled corrugated paper, typically with an included angle of 90 degrees, is for protecting the corners of a rectangular article such as a central heating boiler; four sections are located along each side corner, and provide not only cushioned protection for the corners, even after several impacts, but they are also end load bearing i.e. in shear, and so allow double or treble stacking, with more efficient use of warehouse space and without need for racking. Thus as seen in FIG. 8, the side corners 40 of boiler 41 are protected by sections 42 of angled corrugated paper of L-cross section, held by straps 43 or an outer wrapping (not shown). In this embodiment, sections 41 are each of a multi-layer angled corrugated paper formed with a 90 degree included angle.

The angled sections 42 are typically cut from a longer length formed as described above, and both for its intended use, and for accurate sawing and cutting, whether by the supplier or on site, the formed length needs to be dimensionally stable, with the adhesive having been properly cold worked during forming.

The "double-headed" machine described does not cause undue operator fatigue, the upper and lower jaws both being at a convenient height to avoid the need to bend or stretch. The machine is narrow in depth and thus does not need the additional floor space that would be required for a pair of "single-headed" machines. A single pair of accurately ground, fixed guide rods are used by both the upper and lower formers, with a saving in cost and a more efficient and controlled operation. The sliding bearings can readily be kept lubricated. The control panel 70 can be under operator control, but in an alternative embodiment includes a delay to prevent premature jaw lifting and opening i.e. prior to full cold working of the adhesive; or the cycle time is fully pre-set for automated operation. For one former the rack and pinion is thereabove, for the other it is therebelow, as are the associated motors; the motor rotations can be arranged in order to avoid the racks being handed. The guide rods 21 which are common to both the upper sub-assembly 71 and the lower sub-assembly 72 can be accurately located before fixing in cross-struts 102 of machine frame 100.

I claim:

1. Forming machine for converting a roll of a length of corrugated paper defining a first shape into a length of corrugated paper having a desired second shape, a first former having an outer surface conforming to said second shape, and corresponding first jaw means, means for moving said first former and said first jaw means relative to each other between an open position and a closed position wherein said former engages and squeezes a roll of corrugated paper received on said jaw means to convert said roll to said second shape, a second former proximate said first former and having a shaped outer surface and second corresponding jaw means, and means for moving said second former and jaw means relative to each other subsequent to the relative movement of said first former and jaw means to convert a second roll of a length of corrugated paper received on said second jaw means into a shape conforming to the shape of the outer surface of said second former.

2. The forming machine of claim 1 wherein said first and second jaw means are normally positioned beneath said first and second formers, respectively and the respective moving means moves said first and second formers between their respective open and closed conditions.

3. Forming machine according to claim 2 wherein the first and second formers are located on common guide posts.

4. Forming machine according to claim 2 wherein said moving means for said first and second formers comprise respective first and second rack and pinion means operatively connected to said formers, said first and second racks having respective bosses slidable on a guide post.

5. Forming machine according to claim 2 wherein said first former and jaw means are located above said second former and jaw means and said first and second formers are driven between their open and closed conditions by electric motors located respectively above said first former and below said second jaw means, and wherein the motors are energized in timed sequence.

6. Forming machine according to claim 2 wherein the first and second formers are each connected to a respective counterbalance arranged to urge each former towards its open condition.

7. Forming machine according to claim 2 wherein the first and second jaw means are coupled to a respective counterbalance urging the jaw means to follow upward movement of said former towards the open condition.

8. Forming machine according to claim 2 wherein said first and second jaw means each comprise a pair of pivoted plates, and wherein respective spacer bars are protrudable into a gap between each former and its associated plates, whereby to hold a roll received on said plates offset prior to being squeezed between the former and plates.

9. Forming machine of claim 2 wherein said first former and said jaw means are arranged vertically over said second former and jaw means.

* * * * *